US011124388B2

(12) United States Patent
Birrer et al.

(10) Patent No.: US 11,124,388 B2
(45) Date of Patent: Sep. 21, 2021

(54) LOCKING SYSTEM FOR ELEVATOR CAR DOOR

(71) Applicant: Inventio AG, Hergiswil (CH)

(72) Inventors: Eric Birrer, Buchrain (CH); Nicolas Gremaud, Richterswil (CH); Michael Geisshusler, Lucerne (CH)

(73) Assignee: INVENTIO AG, Hergiswil NW (CH)

( * ) Notice: Subject to any disclaimer, the term of this patent is extended or adjusted under 35 U.S.C. 154(b) by 729 days.

(21) Appl. No.: 15/748,694

(22) PCT Filed: Jul. 14, 2016

(86) PCT No.: PCT/EP2016/066824
§ 371 (c)(1),
(2) Date: Jan. 30, 2018

(87) PCT Pub. No.: WO2017/016896
PCT Pub. Date: Feb. 2, 2017

(65) Prior Publication Data

US 2019/0002245 A1 Jan. 3, 2019

(30) Foreign Application Priority Data

Jul. 30, 2015 (EP) ..... 15179193

(51) Int. Cl.
*B66B 13/16* (2006.01)
*B66B 1/34* (2006.01)
*B66B 13/14* (2006.01)

(52) U.S. Cl.
CPC ..... *B66B 13/165* (2013.01); *B66B 1/3492* (2013.01); *B66B 13/143* (2013.01)

(58) Field of Classification Search
CPC ..... B66B 13/22; B66B 3/00; B66B 1/3415; B66B 5/02; B66B 1/3492; B66B 5/0037;
(Continued)

(56) References Cited

U.S. PATENT DOCUMENTS 4,787,481 A 11/1988 Farrar
4,977,984 A * 12/1990 Arnosti ..... B66B 1/50 187/394

(Continued)

FOREIGN PATENT DOCUMENTS

AT 508403 B1 3/2014
CN 1042020 C 2/1999

(Continued)

*Primary Examiner* — Marlon T Fletcher
(74) *Attorney, Agent, or Firm* — William J. Clemens; Shumaker, Loop & Kendrick, LLP

(57) ABSTRACT

A locking system that locks and unlocks a door of an elevator car travelling along a track having stopping points and associated stopping point zones includes a lock mechanism having a locking position wherein the door is immobilized in a closed position and an unlocking position wherein the door can be opened, an actuator for bringing the lock mechanism into the locking and unlocking positions, and a control device activating the actuator to bring the lock mechanism into the unlocking position when the car is located in the region of a stopping point zone. A position detecting unit continuously detects the position of the car relative to the track and communicates the position to the control device that continuously detects whether the car is located in the region of a stopping point zone by comparing the communicated car position to stored position limit values of the stopping point zones.

14 Claims, 3 Drawing Sheets

(58) Field of Classification Search
CPC ..... B66B 13/20; B66B 1/28; B66B 5/0018; B66B 13/16; B66B 13/165; B66B 13/24; B66B 13/26
See application file for complete search history.

(56) References Cited

U.S. PATENT DOCUMENTS 5,655,627 A 8/1997 Horne et al.
8,960,372 B2 * 2/2015 Heath ..... B66B 13/185 187/301
2004/0216320 A1 11/2004 Birrer et al.
2006/0032711 A1 * 2/2006 Marchesi ..... B66B 1/3492 187/394
2006/0174540 A1 * 8/2006 Oberleitner ..... B66B 13/12 49/118
2008/0000727 A1 * 1/2008 Dziwak ..... B66B 13/20 187/319
2008/0196979 A1 * 8/2008 Sakurai ..... B66B 1/2458 187/387
2009/0178890 A1 * 7/2009 Sakurai ..... B66B 1/2458 187/387
2009/0255762 A1 * 10/2009 Ketonen ..... B66B 13/22 187/247
2009/0321192 A1 * 12/2009 Kattainen ..... B66B 13/22 187/279
2011/0186386 A1 * 8/2011 Gilli ..... B66B 13/12 187/324
2015/0014101 A1 * 1/2015 Tracey ..... B66B 13/08 187/319
2015/0307326 A1 * 10/2015 Lustenberger ..... B66B 1/28 187/393
2015/0314988 A1 * 11/2015 Lowe ..... B66F 7/0666 187/269
2016/0101967 A1 * 4/2016 Muller ..... B66B 13/06 187/335

FOREIGN PATENT DOCUMENTS

CN 1616338 A 5/2005
CN 1733585 A 2/2006
JP S5220546 A 2/1977
WO 2005102900 A1 11/2005

* cited by examiner

LOCKING SYSTEM FOR ELEVATOR CAR DOOR

FIELD

The invention relates to a locking system for locking and unlocking a car door of an elevator car of an elevator system, in which elevator system the elevator car can travel along an elevator track having stopping points and associated stopping point zones. The car door can be opened and closed with a door drive and a controllable lock mechanism which can be brought into a locking and an unlocking position, wherein the lock mechanism of the locking system can be brought into the unlocking position only when at least the condition that the elevator car is located in the region of a stopping point zone is met. The present invention also relates to an elevator system comprising such a locking system.

BACKGROUND

Known elevators have a lock mechanism for the car door which locks the car doors when the elevator car is in operation. Stationary magnets are arranged in the elevator shaft in the area of the floors that indicate that a stopping point zone has been reached and that can be detected by a suitable sensor system arranged at the elevator car. As soon as the sensor system determines a stopping point zone by means of the detected magnets and provides the information to the control device, the control device activates the locking device if the control device intends to stop at the respective stopping point. As a result, the locking device is brought into an open position and the car doors can be opened by the door drive.

Such a control device with stopping point zone sensors is known from U.S. Pat. No. 8,960,372 B2. The mounting of the magnets in the elevator shaft is associated with a rather high material and mounting costs, particularly in connection with high buildings.

SUMMARY

An object of the present invention is to reduce the material and mounting costs.

To achieve this objective, a locking system for locking and unlocking a car door of an elevator car of an elevator system is proposed. In this elevator system, the elevator car can travel along an elevator track having stopping points and associated stopping point zones. The locking system comprises a lock mechanism that can be brought into a locking position and an unlocking position, wherein the car door in the locking position of the lock mechanism is immobilized in the closed position and can be opened in the unlocking position of the lock mechanism, an actuator, by which the locking mechanism can be brought either into locking position of the locking mechanism or into the unlocking position of the locking mechanism, a control device which causes the actuator to bring the locking mechanism into the unlocking position of the locking mechanism when at least the condition that the elevator car is located in the region of a stopping point zone is met.

The locking system is characterized in that the elevator system comprises a position detecting unit which continuously detects the position of the elevator car relative to the elevator track and communicates the position to the control device, and the control device continuously detects whether the condition that the elevator car is located in the region of a stopping point zone is met by comparing the position of the elevator car communicated by the position detecting unit to stored position limit values of the stopping point zones.

In the locking system, the stopping point zones are determined by means of a comparison of programmed stopping point zone limits with measured car position values. If a stopping point zone is observed in the stopping point zone, the control device controls the locking device. This has the advantage that magnets that indicate the stopping point zones are no longer required, which reduces the material and mounting costs, particularly in high buildings.

Preferably, the same position detecting unit that detects the position of the elevator car as input for a drive control of the elevator car is also used to detect the position of the elevator car. The position detecting unit can function in a particularly efficient manner because the signals provided by the position detecting unit can be used in several ways.

Preferably, the position limit values of the stopping point zones are adjustable and/or changeable by means of a programming device. This results in a particularly user-friendly handling of the locking system. It is possible for example to reprogram the timing of the door opening at a later time as well without an expensive adaptation of the hardware, in particular a repositioning of the magnets at the stopping point zones. An adaptation of driving parameters such as the arrival speed of the elevator car at a stopping point zone can easily be taken into account, for example, as part of an elevator system modernization.

Preferably, the position detecting unit comprises a measuring tape with code extending along the entire length of the elevator track as well as a detector mounted on the elevator car which detects the code of the measuring tape. This results in the possibility to continuously determine the position of the elevator car.

Of course, other types of position detecting units can be used as well, which can differ in their mode of operation. Laser position encoders, ultrasound position encoders, optical position detecting units, as well as position detecting units based on discrete measuring methods can be used.

Preferably, the code of the measuring tape is configured such that absolute values of the position of the elevator car can be detected by the detector or by the control device, respectively. The term absolute value refers to a value derived from a code which is unique in the entire area of the elevator track and which allows a clear, direct determination of the position of the elevator car.

In a particularly preferred embodiment, the code of the measuring tape is formed as a so-called Manchester code in which the absolute position of the detector and therefore of the elevator car can be derived from the simultaneous detection of a plurality of successive code marks, each with one of two detectable different properties. This results in the possibility of reading the position of the elevator car from the measuring tape in a particularly reliable and robust manner. Such a coded measuring tape is particularly used in the area of fast-moving elevator cars. The invention does not, however, depend on the use of a single type of code. Of course, other types of code that deviate from this, such as binary code, can be used.

Preferably, the measuring tape is a steel strip which has a code in the form of magnetic code marks formed by zones of the steel strip magnetized as north pole and south pole. The advantage of the design of the measuring tape as a steel band lies in the reliable and simple tensibility along the elevator track.

Preferably, the actuator by which the lock mechanism is brought either into its locking position or its unlocking position comprises an electrically controllable solenoid. In a particularly preferred embodiment, the solenoid is formed as a bistable solenoid. The use of an electrically controllable solenoid in conjunction with the actuator and the control device leads to a particularly simple automated switching arrangement.

Preferably, the control device causes the actuator to bring the lock mechanism into its unlocking position when at least the additional condition is met that a stop of the elevator car is planned at the next stopping point in the direction of travel. By means of this additional condition, it is ensured that the locking system does not cause the actuator to bring the locking system into its unlocking position when the elevator car just passes by a stopping point or an associated stopping point zone. This way, the car door remains reliably locked when passing by a stopping point.

Preferably, the control device causes the actuator to bring the lock mechanism into its unlocking position when at least the additional condition is met that the traveling speed of the elevator car has decreased to a defined maximum value. The defined maximum value constitutes a speed value that is less than the nominal speed of the elevator car in normal operation and can clearly infer an intended stop at a stopping point.

Preferably, the control device causes the actuator to bring the lock mechanism into its locking position when at least the conditions are met that a drive command is pending for the elevator car and that the car door is closed. This way, it is not possible for the elevator car to travel with opened elevator car doors which guarantees the safety of the elevator system.

Preferably, the control device is designed such that in the presence of defined safety conditions, the unlocking position of the lock mechanism can be effected by one person by means of at least one unlocking switch from at least one position in the elevator system. Such safety conditions are met for example during the evacuation of passengers trapped in the elevator car when an authorized person switches the elevator system to an evacuation mode. This way, the authorized person can easily and safely unlock the car door and free the trapped passengers from the elevator car.

Preferably, the elevator system has at least one emergency power system that guarantees that, in the event of a power failure, the locking mechanism can be brought to its unlocking position by the elevator control or by means of at least an unlocking switch. This guarantees that passengers do not remain trapped in the elevator car in the event of a power failure.

DESCRIPTION OF THE DRAWINGS

The invention is described below using an exemplary embodiment which is illustrated schematically in the enclosed drawings. In the drawings.

DETAILED DESCRIPTION

Figure 1:
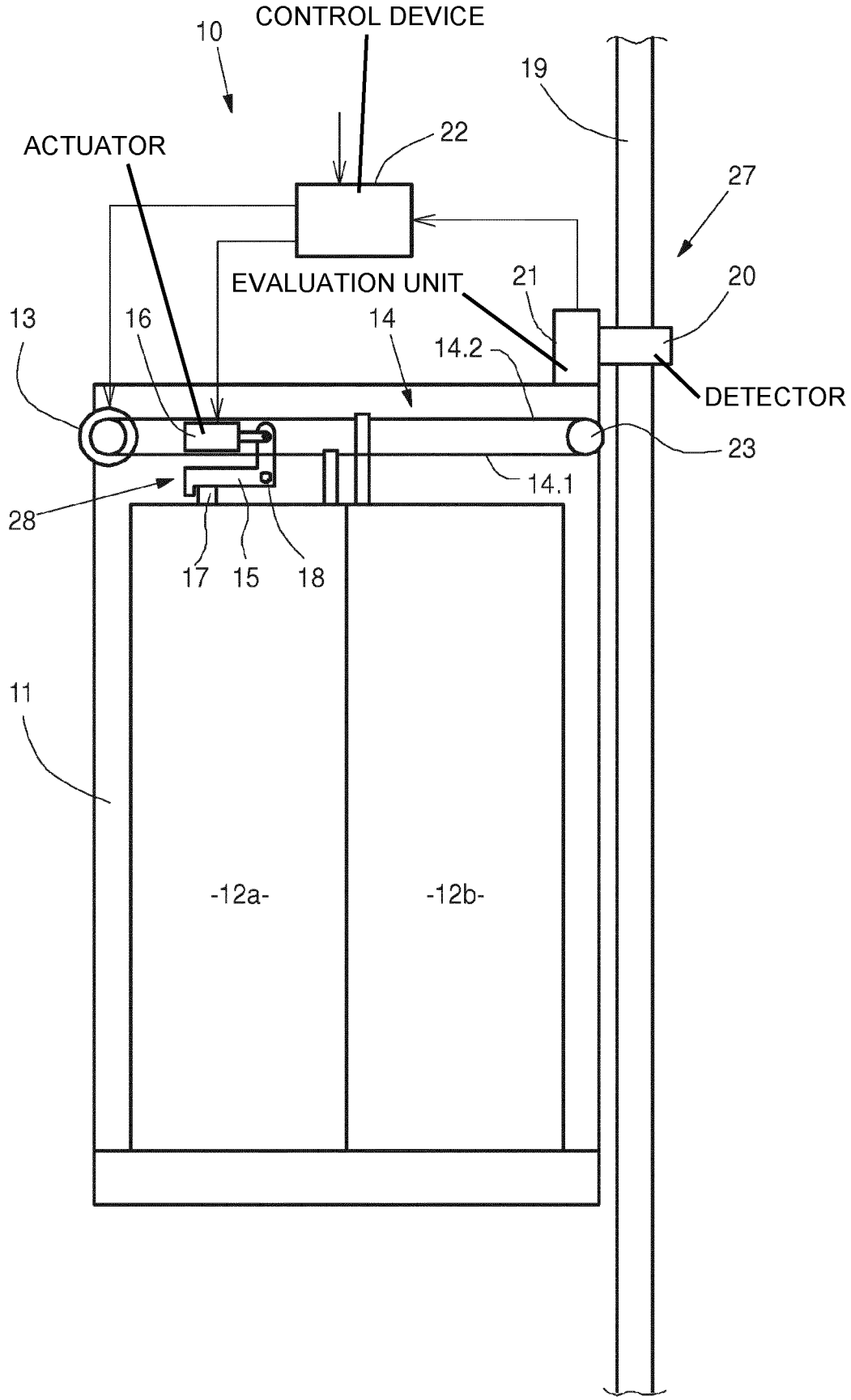
FIG. 1 shows a schematic representation of the elevator system with a locking system according to the invention.

FIG. 1 shows an elevator system 10 comprising an elevator car 11 that can be moved in an elevator shaft which is not shown in the vertical direction along the elevator track. To this purpose, the elevator system 10 comprises for example the car guide rails which are not shown here, along which the elevator car 11 is guided and a suspension means on which the elevator car 11 suspended. Furthermore, the elevator system 10 comprises a drive which is operatively connected to the suspension means and a counterweight which at least partially balances the weight of the elevator car 11 by means of the suspension means. Neither the drive nor the counterweight is shown here.

The elevator car 11 comprises a car door with two door leaves 12*a*, 12*b* which can be moved by means of a door drive 13. To this purpose, the door drive 13 is equipped with a drive means 14 that is, for example, designed in the form of V belts. The drive means 14 rotates a drive roller of the door drive 13 and a pulley 23, whereby the drive means 14 forms a closed loop with a first side 14.1 and a second side 14.2 which are each delimited by the drive roller and the pulley 23.

The first door leaf 12*a* and the second door leaf 12*b* are each connected respectively to the first side 14.1 and with the second side 14.2 so that a rotational movement of the drive roller of the door drive 13 creates an opening or closing movement of the first door leaf 12*a* and the second door leaf 12*b* in the opposite direction by means of the drive means 14.

A position detecting unit 27 is arranged in the elevator shaft that detects a cable position. The position detecting unit 27 shown here comprises a measuring tape 19 that extends along the elevator track, a detector 20 that is arranged on the elevator car 11 that is configured to detect the code on the measuring tape 19. The position detecting unit 27 also comprises an evaluation unit 21 that converts the detected code into a position. In the exemplary embodiment shown, the measuring tape 19 is preferably designed as a steel band. The measuring tape 19 is a carrier of a so-called Manchester code, wherein the Manchester code is the result of a pseudo-sequence of code marks magnetized as north pole or south pole. The detector 20 is preferably designed as a Hall sensor suitable for detecting the magnetic code marks. The detected code marks are finally sent to the evaluation unit 21 which calculates a position from them. A position detecting unit that is based on a Manchester code is described for example in WO 03/011733 A1.

A lock mechanism 28 is provided above the first door leaf 12*a* comprising a bolt 15, a swivel 18, and a locking cam 17. The bolt 15 formed in an L shape here is in a pivotable position on the swivel 18. The locking cam 17 is arranged on the first door leaf 12*a*. The lock mechanism 28 is connected to an actuator 16. The lock mechanism 28 can be brought to a locking position or to an unlocking position by means of the actuator 16. In the process, the actuator 16 pivots the bolt 15 around the swivel 18.

The locking cam 17 is dimensioned with respect to the position of the bolt 15 such that it cooperates with the bolt 15, whereby the bolt 15 forms a stop for the locking cam 17 in the locking position of the lock mechanism 28 and prevents the locking cam 17 or respectively the first door leaf 12*a* directly and the second door leaf 12*b* indirectly from an opening movement by means of the drive means 14. In the unlocking position of the lock mechanism 28, the bolt 15 releases the locking cam 17 or respectively the two door leaves 12*a*, 12*b* for an opening movement so that the door leaves 12*a*, 12*b* can be moved by the door drive 13.

A control device 22 is provided to control the actuator 16 and the door drive 13 which is connected to the position detecting unit 27. The control device 22 is preferably integrated in a door drive control which may also include other control functions. The structure and operation of the control device 22 are described below with reference to FIG. 2.

Figure 2:
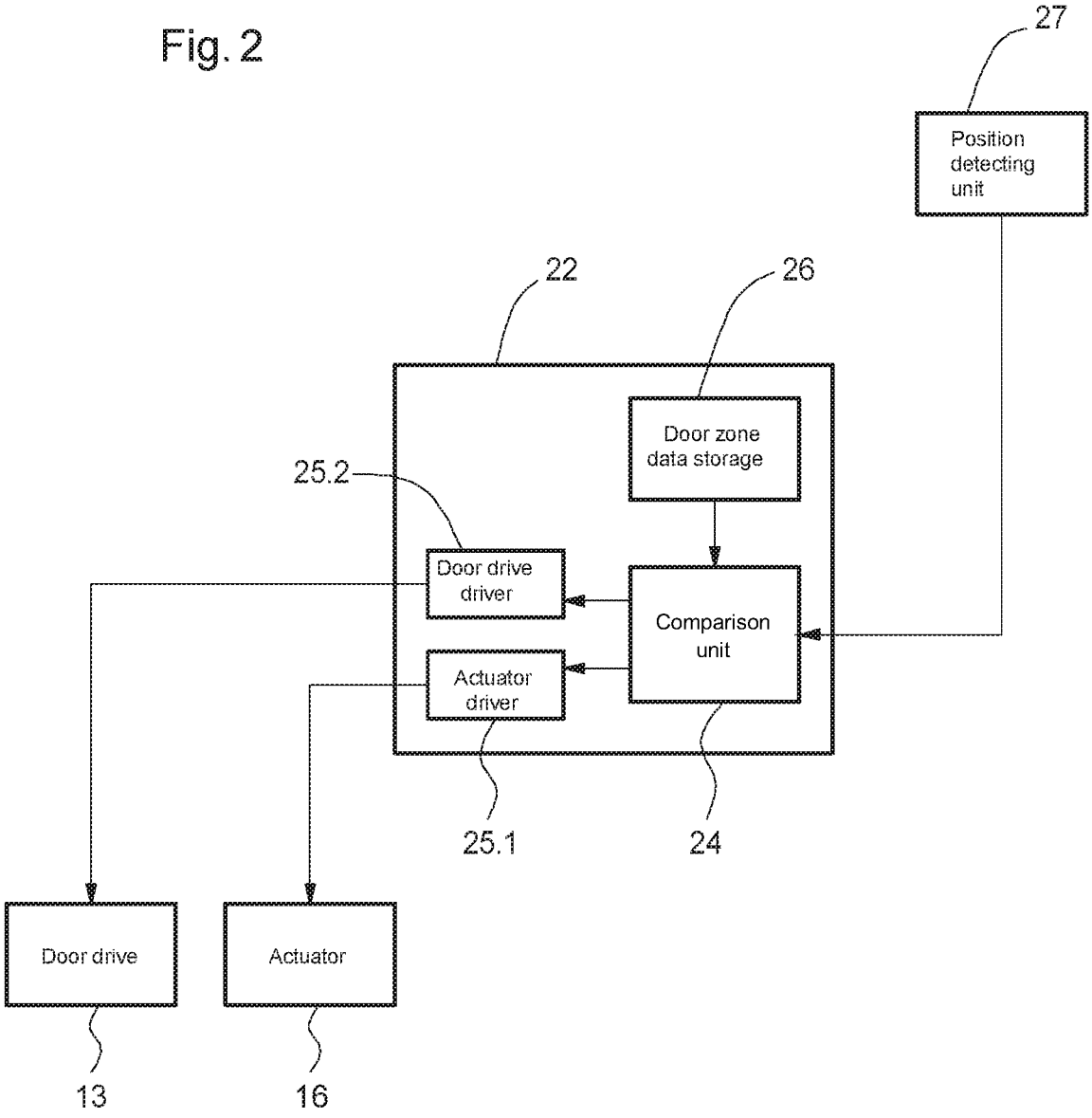
FIG. 2 shows a block diagram of the locking system according to the invention.

FIG. 2 shows a block diagram of the control device 22. The control device 22 includes a comparator 24, a door zone data storage 26, as well as an actuator driver 25.1 and a door drive driver 25.2. The position detecting unit 27 transmits the current position of the elevator car 11 to the control device 22. The comparator 24 compares the transmitted position of the elevator car 11 with the position limit values of the stopping point zones which are stored in the door zone data storage 26 and provided to the comparator 24 for comparison. The position limit values of the stopping point zones can be programmed in the door zone data storage 26 at the factory or may be stored in the door zone data storage 26 during the installation of the elevator system 10.

The output of the comparator 24 is connected to a respective actuator driver 25.1 and a door drive driver 25.2 which respectively control the actuator 16 or the door drive 13.

Figure 3:
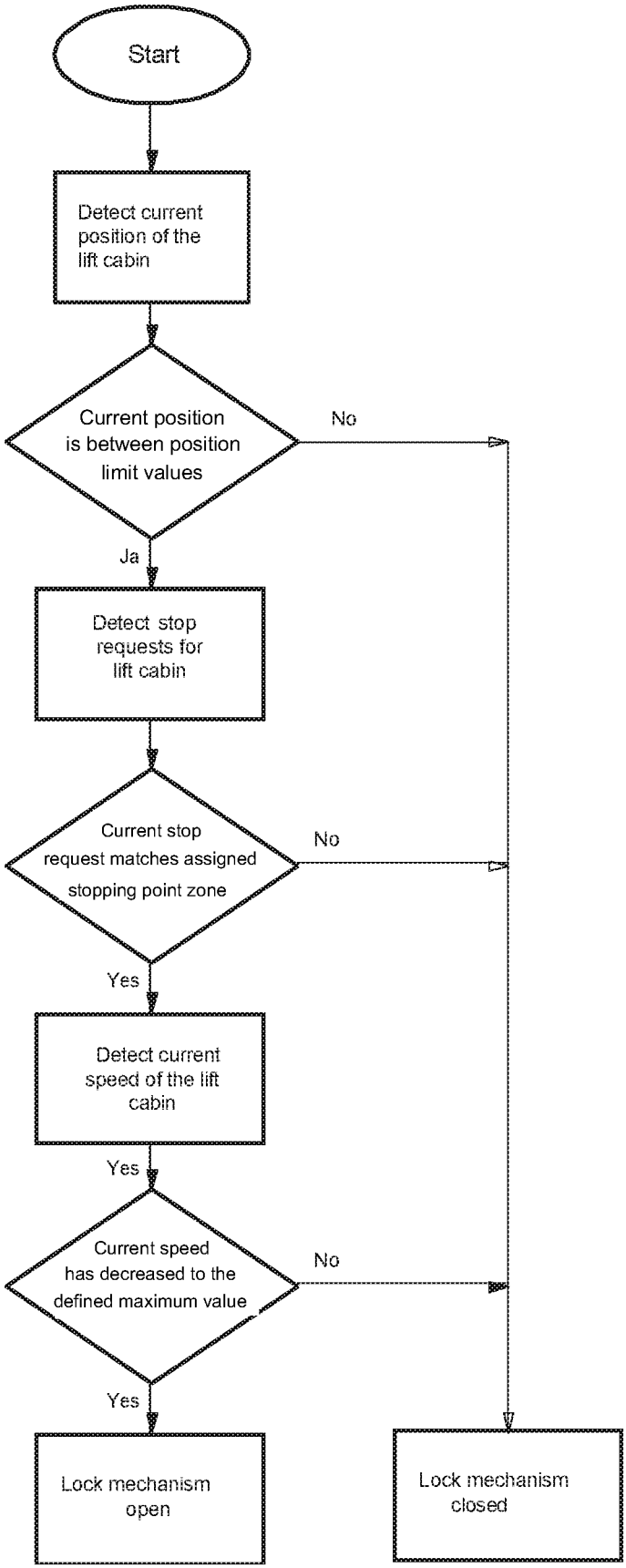
FIG. 3 shows a flow diagram of the locking system according to the invention.

FIG. 3 shows a flowchart of the operation of the control device 22. If, in a comparison performed by a comparator, the current position of the elevator car 11 matches with a stored position limit value of a stopping point zone or if it lies between two position limit values delimiting the stopping point zone, a first condition for the release of the lock mechanism 28 for a door opening is fulfilled.

Preferably, a further condition for the release of the lock mechanism 28 is met when the control device 22 disposes of data that is provided at the stopping point associated with the respective stopping point zone. Data about the intended stop at a stopping point is stored in the control device 22 due to requests to stop.

Such requests to stop are generated, for example, by car call buttons at the stopping points and/or destination input buttons in the elevator car 11. For this, the car call buttons and/or the destination input buttons are connected to an elevator control. The elevator control plans the travel of the elevator car 11 on the basis of these requests to stop and issues the respective travel commands to the drive. The data about scheduled stops are preferably provided to the control device 22 from the elevator control.

Optionally, or alternatively, another condition for the release of the lock mechanism 28 is met when the control device 22 disposes of data indicating that the speed of the elevator car 11 has decreased to a defined maximum value. Data about the speed of the elevator car 11 can be determined in the position detecting unit 27 from a derivative of the position of the elevator car 11 over time and provided to the control device 22. Here, the current speed of the elevator car 11 is compared with a defined maximum value stored in the control device 22.

When at least one of the aforementioned conditions is met, the actuator driver 25.1 controls the actuator 16 in such a way that the bolt 15 is brought into its unlocking position. The car door is therefore released for an opening movement. Furthermore, when reaching or shortly before reaching the stopping point, the door drive driver 25.2 controls the door drive 13 in such a way that the door drive 13 opens the door leaves 12*a*, 12*b* of the car door.

The actuator driver 25.1 furthermore causes the actuator 16 to bring the bolt 15 into its locking position again when the control device 22 has at least a pending travel command to satisfy a further stop request and when, first, the door drive driver 25.2 has caused the door drive 13 to close the car door.

Optionally, the elevator system 10 has an unlocking switch. Using the unlocking switch, an authorized person can bring the lock mechanism 28 into an unlocking position. Predefined safety conditions must be met so that the lock mechanism 28 can be brought into its unlocking position with an unlocking switch. The elevator system 10 must for example be brought into a separate operating mode in which certain functions that are available in a normal operating mode are prohibited. The authorized person can, for example, put the elevator system 10 in an evacuation mode in which the car is prevented from traveling and the unlocking switch is activated. The authorized person can hereby free trapped passengers from the elevator car 11.

To this purpose, the control device 22 is connected with the unlocking switch and disposes of an input interface where the authorized person can change the operating mode by entering a command or by operating the switch. The input interface and the unlocking switch can, for example, be in spatial proximity with the control device 22 or even the elevator control or even in a respective housing of the control device 22 or the elevator control. The input interface and the unlocking switch can generally be arranged at other locations of the elevator system 10 as well, such as, for example, a shaft door frame or a separate machine room that is accessible to the authorized person without great effort.

Optionally, the elevator system 10 may include an emergency power supply unit which provides at least the control unit 22 and the actuator 16 with power even in the event of a power failure. In an especially preferred embodiment, the position detection unit 27, the door drive 13, and/or the unlocking switch are supplied with power from the emergency power supply unit as well.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. A locking system for locking and unlocking a car door of an elevator car of an elevator system, in which elevator system the elevator car travels along an elevator track having stopping points and associated stopping point zones, comprising:

a lock mechanism having a locking position and an unlocking position, wherein the car door in the locking position of the lock mechanism is immobilized in a closed position and can be opened in the unlocking position of the lock mechanism;

an actuator for bringing the lock mechanism into the locking position and the unlocking position;

a control device for controlling the actuator to bring the lock mechanism into the unlocking position when at least a condition is met that the elevator car is located in a region of one of the stopping point zones; and a position detecting unit which continuously detects a current position of the elevator car relative to the elevator track and communicates the position to the control device, the control device continuously detecting whether the condition that the elevator car is located in the region of one of the stopping point zones is met by comparing the current position of the elevator car communicated by the position detecting unit to stored position limit values of the stopping point zones, and where the position detecting unit also continuously detects the current position of the elevator car as an input for a drive control of the elevator car.

2. The locking system according to claim 1 wherein the stored position limit values of the stopping point zones are at least one of adjustable and changeable by a programming device.

3. The locking system according to claim 1 wherein the position detecting unit includes a measuring tape with a code extending along an entire length of the elevator track and a detector mounted on the elevator car for detecting the code of the measuring tape.

4. The locking system according to claim 3 wherein the code of the measuring tape is configured such that absolute values of the position of the elevator car can be detected by the detector or by the control device.

5. The locking system according to claim 3 wherein the code of the measuring tape is formed as a Manchester code in which an absolute position of the detector and the elevator car can be derived from a simultaneous detection of a plurality of successive code marks, each of the code marks having one of two detectable different properties.

6. The locking system according to claim 3 wherein the measuring tape is a steel strip which has the code as magnetic code marks formed by zones of the steel strip magnetized as north poles and south poles.

7. The locking system according to claim 1 wherein the actuator by which the lock mechanism is brought into the locking position and the unlocking position includes an electrically controllable solenoid.

8. The locking system according to claim 7 wherein the solenoid is a bistable solenoid.

9. The locking system according to claim 1 wherein the control device causes the actuator to bring the lock mechanism into the unlocking position when at least an additional condition is met that a stop of the elevator car is planned at a next stopping point in a direction of travel of the elevator car.

10. The locking system according to claim 1 wherein the control device causes the actuator to bring the lock mechanism into the unlocking position when at least an additional condition is met that a traveling speed of the elevator car has decreased to a defined maximum value.

11. The locking system according to claim 1 wherein the control device causes the actuator to bring the lock mechanism into the locking position when at least both conditions are met that a drive command is pending for the elevator car and that the car door is closed.

12. The locking system according to claim 1 wherein the control device in a presence of defined safety conditions permits the unlocking position of the lock mechanism to be effected by a person using least one unlocking switch from at least one position in the elevator system.

13. The locking system according to claim 1 including at least one emergency power system that in an event of a power failure enables the locking mechanism to be brought to the unlocking position by the control device or by an unlocking switch.

14. An elevator system comprising:

an elevator car having a car door, the elevator car travelling along an elevator track having stopping points and associated stopping point zones; and a locking system for locking and unlocking the car door including, a lock mechanism having a locking position and an unlocking position, wherein the car door in the locking position of the lock mechanism is immobilized in a closed position and can be opened in the unlocking position of the lock mechanism;

an actuator for bringing the lock mechanism into the locking position and the unlocking position;

a control device for controlling the actuator to bring the lock mechanism into the unlocking position when at least a condition is met that the elevator car is located in a region of one of the stopping point zones; and a position detecting unit which continuously detects a current position of the elevator car relative to the elevator track and communicates the position to the control device, the control device continuously detecting whether the condition that the elevator car is located in the region of one of the stopping point zones is met by comparing the current position of the elevator car communicated by the position detecting unit to stored position limit values of the stopping point zones, and wherein the position detecting unit also continuously detects the current position of the elevator car as an input for a drive control of the elevator car.

* * * * *